United States Patent [19]

Denisot

[11] Patent Number: 4,523,439

[45] Date of Patent: Jun. 18, 1985

[54] REFRIGERATED DISPLAY UNIT

[75] Inventor: Bernard A. Denisot, Nogent-sur-Marne, France

[73] Assignee: Societe Laitiere de Veron, Savigny-le-Temple, France

[21] Appl. No.: 561,203

[22] Filed: Dec. 14, 1983

[30] Foreign Application Priority Data

Dec. 14, 1982 [FR] France ..... 82 20913
Nov. 14, 1983 [FR] France ..... 83 18010

[51] Int. Cl.[3] ..... A47F 3/04

[52] U.S. Cl. ..... 62/251; 62/252; 62/253; 312/116; 312/236

[58] Field of Search ..... 62/249, 251, 252, 253, 62/255, 256; 312/116, 125, 236

[56] References Cited

U.S. PATENT DOCUMENTS

| | | | |
|---|---|---|---|
| 1,829,024 | 10/1931 | Teasley . | |
| 2,030,780 | 2/1936 | Bicknell | 312/99.5 |
| 2,298,790 | 10/1942 | Klassen | 62/249 X |
| 2,463,658 | 3/1949 | Thrasher | 62/253 |
| 2,490,413 | 12/1949 | Burtis | 62/249 |
| 2,499,089 | 3/1950 | Brill | 62/89.5 |
| 2,502,076 | 3/1950 | Denton | 62/249 |
| 2,503,419 | 4/1950 | Secunde | 62/251 X |
| 2,555,425 | 6/1951 | Stern | 62/251 |
| 2,565,795 | 8/1951 | Amundsen, Jr. | 62/252 X |
| 2,645,096 | 7/1953 | Kuhn | 62/253 |
| 2,888,811 | 6/1959 | Hargrave | 62/255 |
| 3,046,757 | 7/1962 | Bank | 62/251 |
| 4,179,168 | 12/1976 | Isaac | 312/125 |
| 4,211,331 | 7/1980 | Salmon | 211/13 |

FOREIGN PATENT DOCUMENTS

| | | |
|---|---|---|
| 985738 | 6/1951 | France . |
| 2096381 | 1/1970 | France . |
| 2172478 | 2/1972 | France . |
| 2196582 | 3/1974 | France . |
| 2385366 | 4/1977 | France . |
| 904719 | 12/1958 | United Kingdom . |
| 1483056 | 11/1973 | United Kingdom . |

*Primary Examiner*—Lloyd L. King
*Attorney, Agent, or Firm*—Sandler & Greenblum

[57] ABSTRACT

A refrigerated display case is provided which includes a framework having a plurality of first panels connected to each other to form a structure having a polygonal cross-section. Each first panel is connected to an adjacent first panel such that an extending portion of the first panel extends beyond its connection point to an adjacent first panel. The framework also includes a plurality of second panels, each second panel being connected at one end to an extending portion of a first panel. The framework defines a plurality of refrigeration compartments. Each compartment includes an information board to provide information relating to the products displayed in the compartments.

21 Claims, 6 Drawing Figures

REFRIGERATED DISPLAY UNIT

FIELD OF THE INVENTION

The present invention relates to refrigerated display cabinets or cases, and particularly, refrigerated display cabinets for display and sale of cheese.

BACKGROUND OF THE INVENTION

At present, in supermarket stores or smaller market stores, two techniques are used for displaying cheese for sale. In the first, which is the traditional method, a cutting counter is used where cheese is served by a cheese server. In the second, packaged cheeses are offered after being displaced in refrigerated showcases.

Each of these techniques have disadvantages. In the first case, although it is clear that having a cutting counter adds animation to a store, this process is unprofitable due to high costs and charges. While a packaged counter or refrigerated showcase does not have these disadvantages, nevertheless, cheese so offered suffers a bad image with customers, possibly because present refrigerated cases do not lend themselves to detailed inquiry by consumers.

Furthermore, existing refrigerated cases are adapted in a linear format, and, thus, are not usable in medium-sized or small market stores.

It is, therefore, an object of the present invention to provide an improved refrigerated display case which substantially overcomes the above-described deficiencies in the prior art display cabinets.

SUMMARY OF THE INVENTION

According to the present invention, a refrigerated display case is provided which comprises a framework which includes a plurality of first panels connected to each other to form a polygonal cross-section. Each first panel is connected to an adjacent first panel such that an extending portion of each first panel extends beyond its connection point with an adjacent first panel. The framework further comprises a plurality of second panels, each second panel being connected at one end to an extending portion of a first panel. The framework defines a plurality of refrigeration compartments, each compartment including an information board. The first panels are preferably made of a thermally insulating material. The frame can have a prismatic shape, and the compartments can be disposed on the lateral surfaces formed by the prismatically-shaped frame. One end of a first panel can abut an interior portion of an adjacent first panel. Each second panel can be substantially parallel to a first panel. The first panels can be four in number and, in such case, preferably are disposed substantially perpendicularly relative to adjacent first panels. Also, the second panels can be four in number, with each second panel being disposed substantially perpendicularly relative to a first panel.

The refrigerated display case according to the present invention can also include a refrigeration unit, and a base for supporting the framework, with the base having a truncated-pyramid shape. The small end of the base is adapted to rest on a surface for supporting the case. The base is provided for encasing the refrigeration unit.

Each refrigeration compartment can include at least one shelf, preferably inclined, which connects an extending portion of a first panel with a second panel. The framework can include a plurality of lateral surfaces corresponding to the polygonal cross-section, with the compartments being formed in vertical rows on the lateral surfaces and each compartment including an evaporator. A plurality of first channels are provided, each first channel for connecting a row of evaporators associated with a lateral surface. Each first channel includes means for equalizing the temperature in each compartment which it connects.

The refrigerated display case according to the present invention can also include a plurality of deflecting plates each positioned in front of an evaporator. It can also include a plurality of containers for containing products to be displayed, each compartment including a container, with spacing means being provided for creating a space between the bottom of each container and the inclined shelf associated with a compartment. The spacing means can include at least two elongated spacing members positioned between the bottom of a container and an inclined shelf. The lower edge of each deflecting plate can be disposed above the upper edge of a corresponding container.

The display case according to the present invention can further include a housing for supporting the display case, the housing including a plurality of uprights adapted to be positioned along the vertical edges of the case, the uprights being connected by cross-pieces adapted to be disposed substantially at the level of the at least one inclined shelf.

The display case according to the present invention can also include a plurality of first drain members each having a front edge forming a deflector and extending partially over a container, each first drain member being disposed below an evaporator. Each first drain member can include a first orifice connected to a first evacuation channel which has an opening located above a first drain member associated with a lower refrigeration compartment.

The display case of the present invention can further include a plurality of second drain members each positioned below a front edge of an inclined shelf. Each second drain member can include a second orifice connected to a second channel having an opening located above a first drain member associated with a lower compartment. A plurality of third channels can also be provided for distributing refrigerating fluid from refrigerating unit toward the vertical rows of compartments, each third channel including means for varying fluid flow therethrough. The means for varying fluid flow can include means for adjusting the cross-section of the third channel. A fourth channel can be provided for carrying refrigerating fluid from the refrigerating unit to the plurality of third channels.

The present invention can include a refrigerated showcase having a prismatic shape and having compartments on each of its lateral surfaces is provided. Each compartment is refrigerated and includes an information board adapted to receive a text. The framework of the case is formed by four panels, each made of insulating material, assembled to one another such that the framework has, in cross-section, a polygonal shape, with the same end of each side of the panels extending beyond the adjacent panel. The framework is completed by panels which are fixed by one of their sides against the corresponding free side portion of the panels.

BRIEF DESCRIPTION OF THE DRAWINGS

Embodiments of the present invention are shown in the accompanying drawings, wherein.

DETAILED DESCRIPTION OF THE INVENTION

Figure 1:
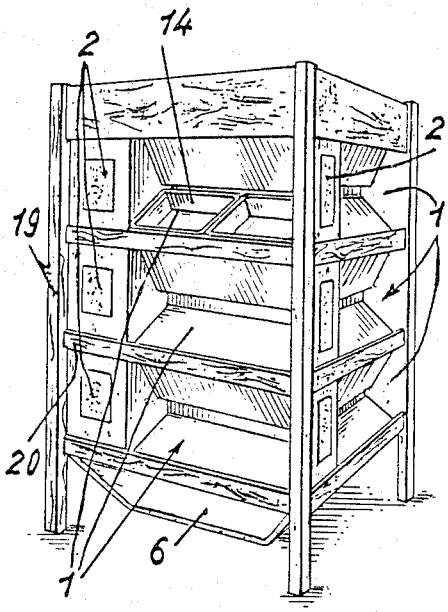
FIG. 1 is a perspective view of a refrigerated display case according to the present invention.
Figure 2:
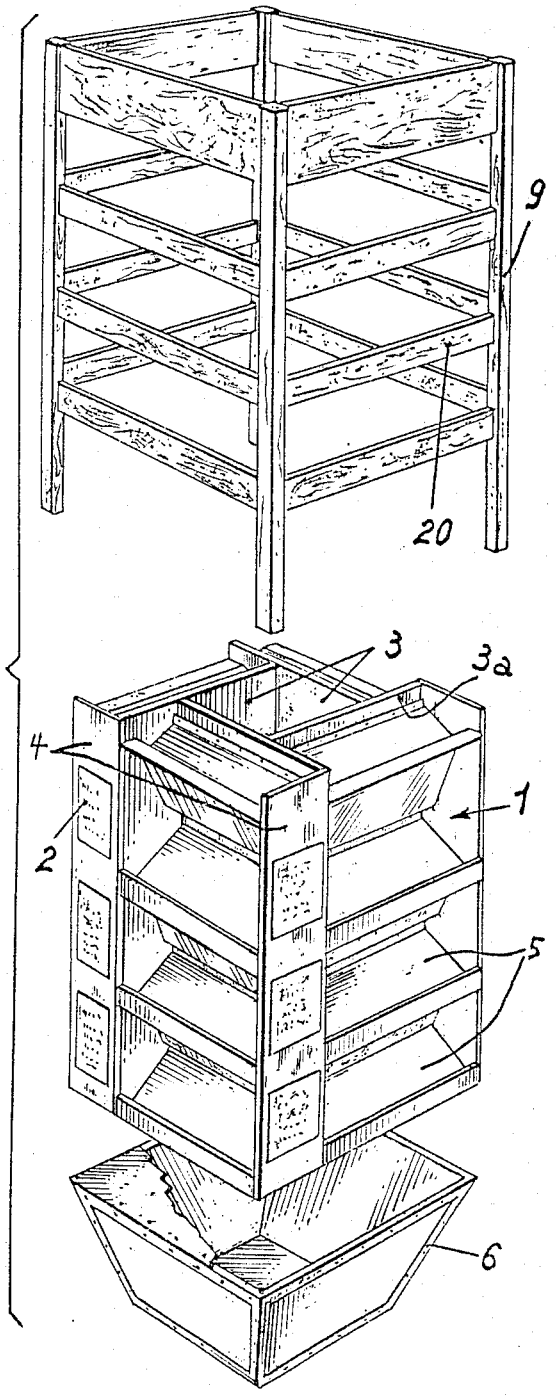
FIG. 2 is an enlarged, exploded, perspective view of the refrigerated display case according to the present invention.

Referring to FIG. 1, the refrigerated display case according to the present invention is illustrated in the form of a prism which includes on each lateral surface refrigerated compartments 1 in which articles for sale, such as cheeses, are placed for display. An information board 2 is also placed on each lateral surface of the display case. Information board 2 is adapted to display an information text, such as promotional data or other pertinent information, e.g., relating to the origin or use of the articles placed in refrigerated compartments 1.

It should be noted that the refrigerated display case shown in FIG. 1 lends itself most readily for use in relatively small stores.

Figure 4:
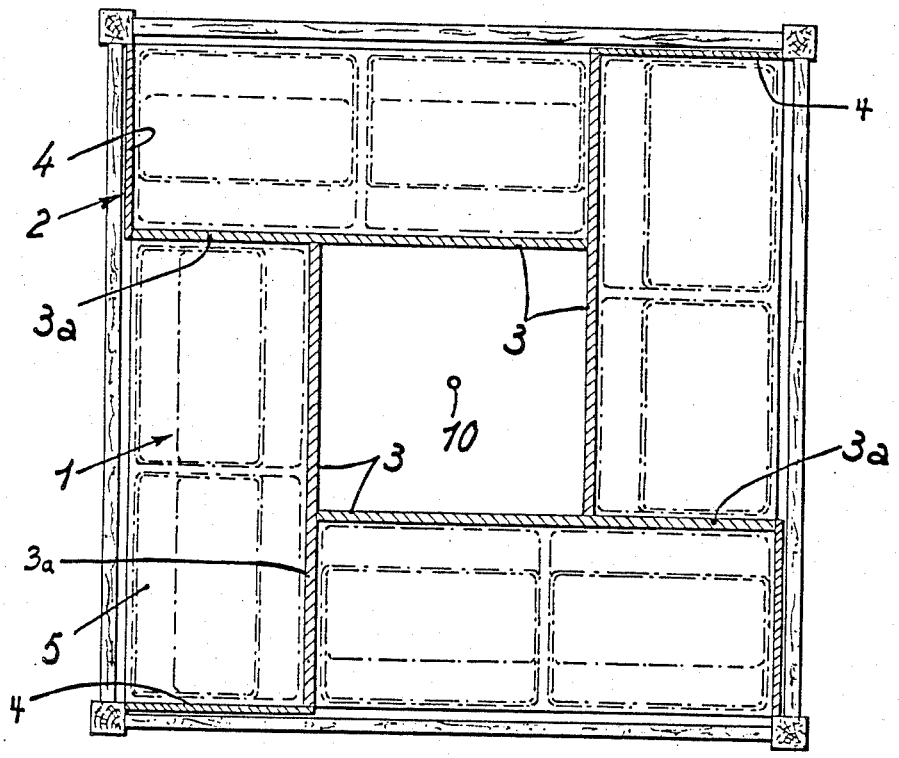
FIG. 4 is a horizontal cross-sectional view of the refrigerated display case according to the present invention.

According to one embodiment, the framework of the case includes four first panels 3, which are preferably made of a thermally insulating material such as polyurethane. First panels 3 are assembled together by any conventional means. As shown particularly in FIG. 4, panels 3 are positioned such that the framework has, in cross-section, a polygonal shape wherein the same end of each side of each first panel 3 has an extending portion 3*a* which extends beyond the adjacent first panel 3. In other words, the framework includes a plurality of first panels 3 connected to each other to form a polygonal cross-section, with each first panel 3 being connected to an adjacent first panel such that an extending portion 3*a* of each first panel extends beyond its connection point with an adjacent first panel.

The framework is completed by second panels 4 which are attached at one of their sides against the free edge of extending portion 3*a* of a corresponding first panel 3. In other words, the framework also includes a plurality of second panels, with each second panel being connected at one end to an extending portion of a first panel.

It should be noted that, as shown in FIG. 1, an end of a first panel 3 abuts an interior portion of an adjacent first panel, and that each second panel is substantially parallel to a first panel. FIG. 1 shows four first panels 3 which are disposed substantially perpendicularly with respect to adjacent first panels and also shows four second panels 4, with each second panel being disposed substantially perpendicularly with respect to a first panel. Refrigeration compartments 1 are defined by first panels 3, second panels 4, extending portions 3*a* of first panels 3 and shelves 5 which are preferably inclined.

The above-described assembly rests on base 6 which is shaped as a truncated pyramid whose small base rests on the floor or other supporting surface. Base 6 preferably is hollow and is used for storing refrigerating unit 7 which is shown schematically in FIG. 3.

According to another characteristic of the present invention, a plurality of evaporators 8 are provided which preferably correspond in number to the number of refrigeration compartments 1. Each evaporator 8 is connected to adjacent refrigeration compartments 1, i.e., compartments both above and below, by means of first channels 9. In other words, each refrigeration compartment 1 includes an evaporator 8; a plurality of first channels 9 are provided, each first channel 9 for connecting evaporators associated with above- and below-adjacent refrigeration compartments 1.

Refrigerating fluid from refrigerating unit 7 is sent through fourth channel 10, positioned substantially at the center of the framework. Fourth channel 10 carries the refrigerating fluid from refrigerating unit 7 to a plurality of third channels 11 through which the fluid is distributed to the upper portion of the refrigerated display case in n paths 11 (n representing the number of lateral surfaces or faces of the refrigerated display case). Each path or third channel 11 is connected to a vertical row of corresponding evaporators 8. In other words, refrigerated compartments 1 are formed in vertical rows on the lateral surfaces of the display case, with each compartment 1 including an evaporator 8. Thus, as noted above, each first channel 9 connects a row of evaporators 8 which are associated with a lateral surface of the display case. Further, fourth channel 10 is connected to the plurality of third channels 11, which themselves are connected to first channels 9.

The portion of each first channel 9 which connects adjacent evaporators 8 of a same face or lateral surface of the display case includes an adjustment apparatus, schematically illustrated by reference numeral 12 in FIG. 5, for adjusting the cross-section of a first channel 9 for passage of refrigerating fluid; apparatus 12 thereby enables equalizing the temperature in each refrigeration compartment 1 connected by first channel 9 having adjustment means 12. An analogous result can be obtained by providing first channels 9 which have cross sections which progressively increase from top to bottom. From the above, it is seen that each first channel 9 is provided, according to the present invention, with means for equalizing the temperature in each refrigerated compartment 1 which it connects.

A deflecting plate 13 is positioned in front of each evaporator 8. Deflecting plates 13 force cold air to descend towards product containers 14 which rest on inclined shelves 5. In other words, heat transfer occurs upwardly away from containers 14. Spacing means are provided for creating spaces 15 between the bottoms of containers 14 and the floors of shelves 5; i.e., a plurality of deflecting plates 13 are provided, each deflecting plate 13 being positioned in front of an evaporator 8. A plurality of containers 14 is provided for containing products to be displayed or positioned on shelves 5, with each refrigerated compartment 1 including a container. Spacing means for creating a space between the bottom of each container 14 and the inclined shelf 5 associated with a compartment 1 are provided.

Figure 3:
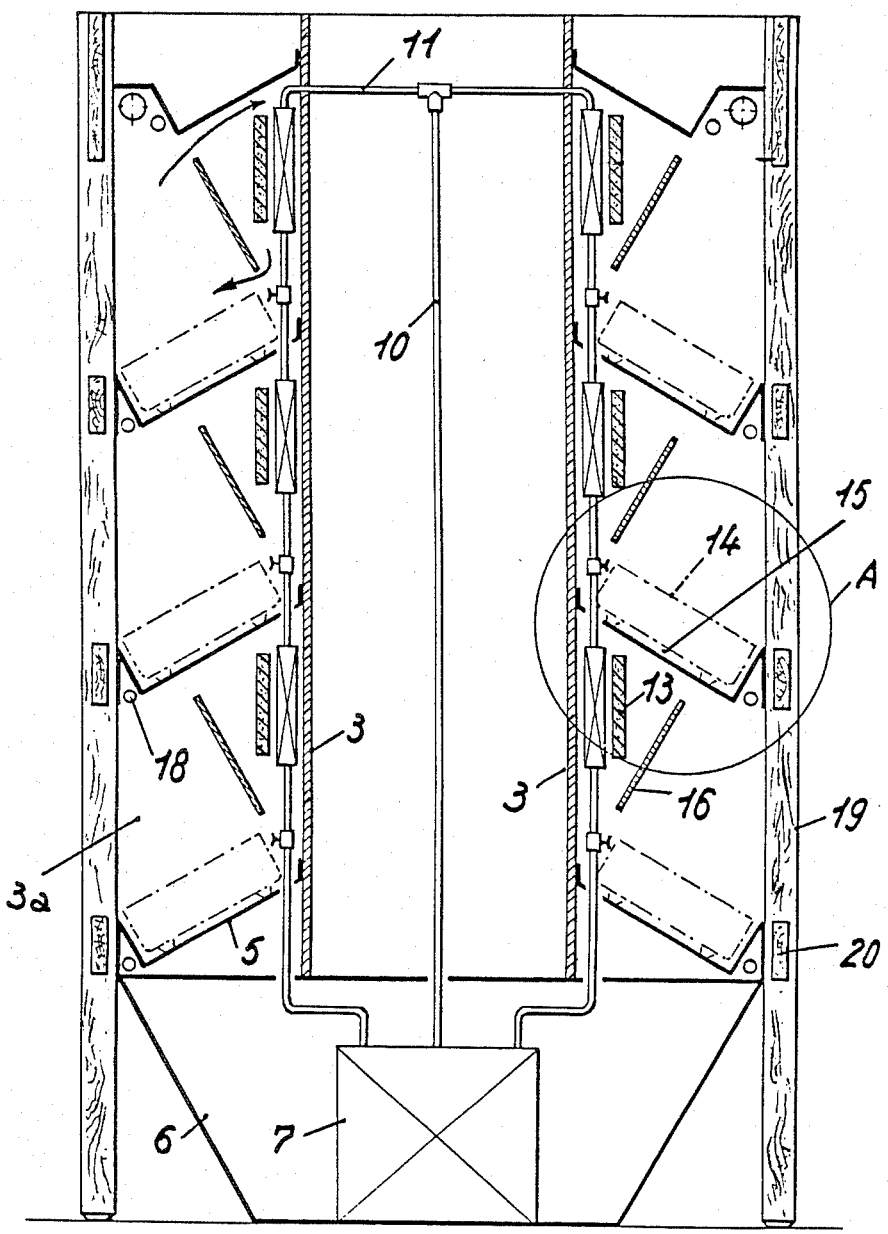
FIG. 3 is an enlarged, vertical cross-sectional view of the refrigerated display case according to the present invention.
Figure 5:
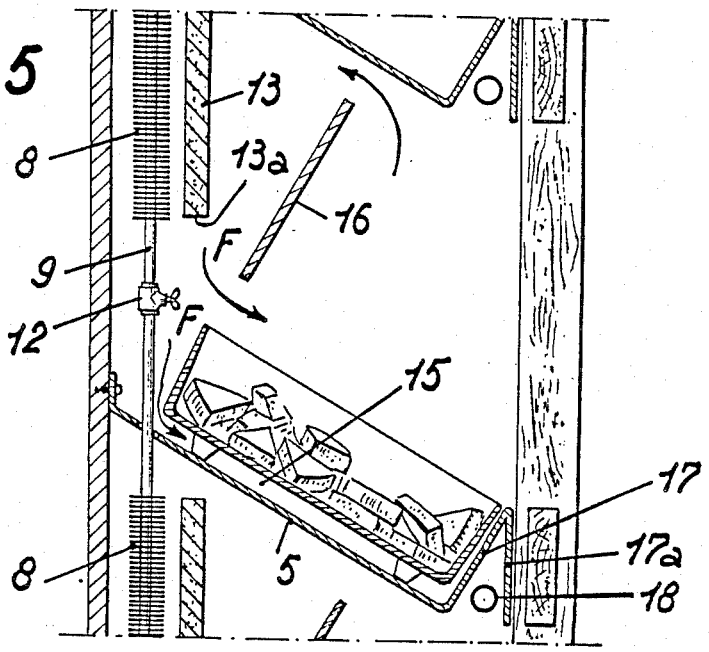
FIG. 5 is a partial cross-sectional view including further enlargement of detail A of FIG. 3.
Figure 6:
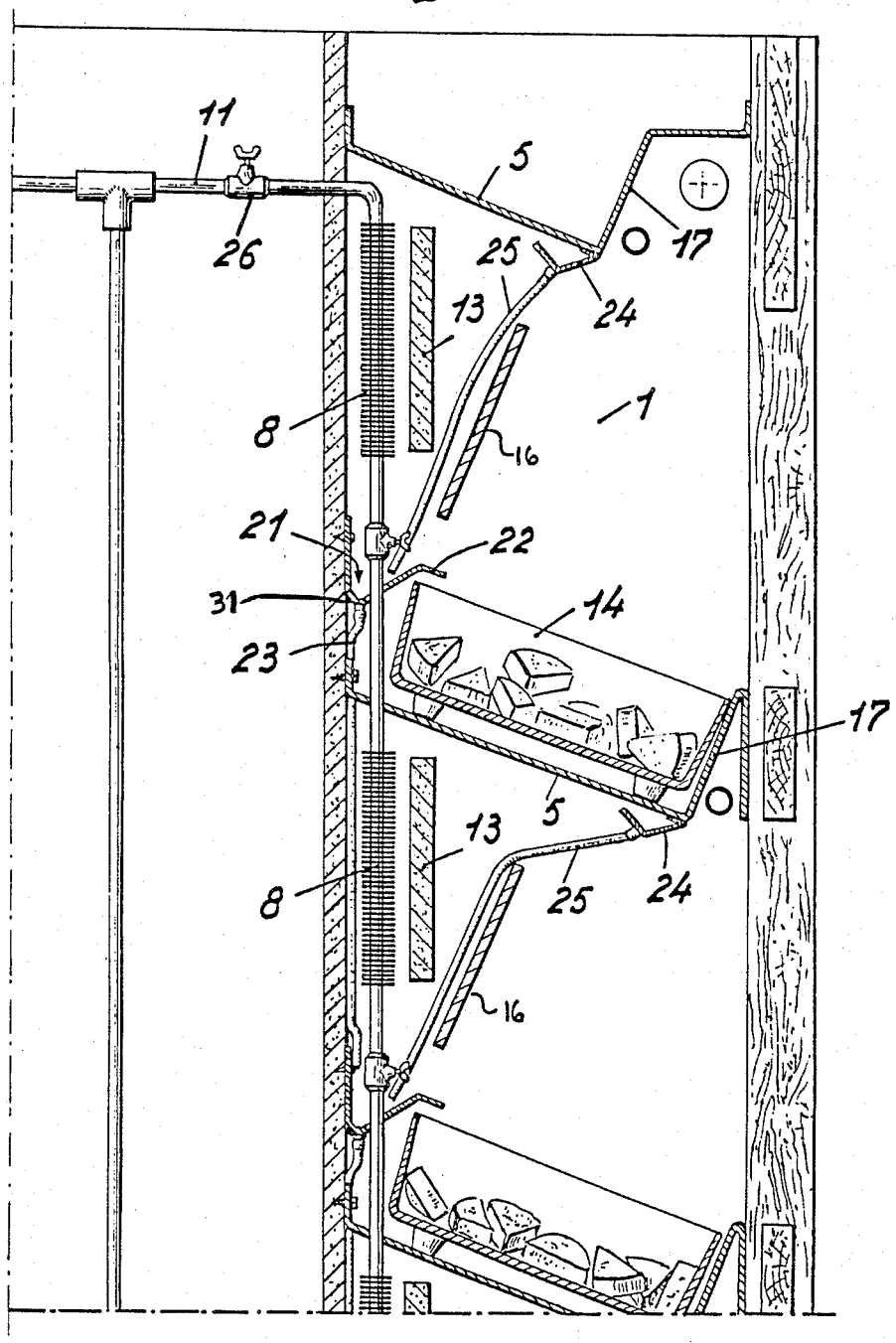
FIG. 6 is an enlarged view similar to that of FIG. 5, illustrating an alternative embodiment of the refrigerated display case according to the present invention.

Lower edges 13*a* of deflecting plates 13 function as deflectors and are positioned above the upper edges of corresponding product containers 14, as shown in FIGS. 5 and 6. In this manner, cold air circulates above and below product containers 14 in the direction of arrows F shown in FIG. 5. As illustrated in FIGS. 3 and 5, mirrors 16 are located in front of deflecting plates 13. Mirrors 16 provide a space between an upper shelf 5 and a lower shelf 5. Each shalf 5 has, along the length of its front edge, a rim 17 curved at 17*a* toward the exterior to allow for placement of a lighting apparatus 18.

According to another aspect of the present invention, the refrigerated display case described above can be housed in a covering or housing, preferably made of wood, formed by uprights 19 which are connected by cross-pieces 20 which extend to the level of rims 17*a*. In other words, a housing is provided for supporting the display case, with the housing including a plurality of uprights adapted to be positioned along the vertical edges of the display case. The uprights are connected by cross-pieces which are adapted to be disposed substantially at the level of the inclined shelves.

According to another aspect of the present invention, a first drain member 21 is positioned under each evaporator 8. Drain member 21 has a front edge 22 which extends above the rear edge of corresponding product container 14, thus forming a deflector as shown in FIG. 6. Each drain member 21 has, preferably at its lowest point, a first orifice 31 connected to a first evacuation channel 23 which opens above the below-adjacent first drain member 21. In other words, a plurality of first drain members 21 are provided each having a front edge 22 forming a deflector and extending partially over a product container 14. Each first drain member 21 is disposed below an evaporator 8. Each first drain member includes a first orifice 31 connected to a first evacuation channel 23 which has an opening located above a first drain member associated with a lower refrigerated compartment 1. In this manner, defrosting water coming from evaporators 8 can be very readily evacuated. First drain members 21 also function to direct cold air onto the tops of product containers 14 by virtue of deflectors 22.

In order to minimize inconveniences resulting from condensation and in order to evacuate drops of water which form in the system, thus avoiding damage to the products located in the product containers 14, the front edge of each shelf 5 includes a second drain member 24 for collecting condensed water and evacuating it by means of a second channel 25 which opens above first drain member 21 of the below-adjacent refrigerated compartment 1. Second drain member 24 is positioned under the front edge of a shelf 5 by any conventional means, e.g., by attaching its ends to the lateral wall of the refrigerated compartment 1, or, as shown in FIG. 5, by integrating the front edge of compartment 1 to the front edge of shelf 5. This is effective in cases where water condensation over the length of rim 17 is not of convern.

In other words, a plurality of second drain members 24 are provided, with each second drain member being positioned below a front edge of an inclined shelf 5. Each second drain member includes a second orifice which is connected to a second channel 25 which has an opening located above a first drain member associated with a lower refrigerated compartment 1.

To equalize the temperature in all of the refrigerated compartments and to insure that the temperature is not affected by the spatial orientation of the display case, an apparatus, illustrated schematically by reference numeral 26 in FIG. 6, is provided on each third channel or branch 11 for distributing the refrigerating or cooling fluid, thus allowing the cross-section of each third channel 11 to be adjusted such that fluid flow can be regulated. In other words, a plurality of third channels 11 are provided for distributing refrigerating fluid from the refrigerating unit 7 toward the vertical rows of refrigerated compartments 1, with each third channel 11 including means 26 for varying fluid flow therethrough. Means 6 can comprise means for adjusting the cross-section of the third channels 11.

From the foregoing description, one skilled in the art can easily ascertain the essential characteristics of the present invention, and without departing from the spirit and scope thereof, can make various changes and modifications of the invention to adapt it to various usages and conditions. Accordingly, the present invention is not limited to the embodiments described herein and illustrated in the Figures, but, extends to all alternative shapes, materials and dimensions.

I claim:

1. A refrigerated display case comprising:

(a) a framework comprising a plurality of first panels connected to each other to form a structure having a substantially polygonal cross-sectional area, each of said first panels being connected to an adjacent one of said first panels and having a portion extending beyond the point at which each said first panel is connected to an adjacent first panel, said framework further comprising a plurality of second panels, each of said second panels having one end which is connected to an extending portion of a respective one of said first panels, said framework defining a plurality of generally vertical refrigerated compartments, each of said compartments being defined by one of said first panels, one of said second panels, and an extended portion of a first panel other than said one first panel;

(b) a plurality of evaporators in each of said compartments, said plurality of evaporators being fluidically interconnected, at least one control valve being associated with each of said evaporators;

(c) a deflecting plate being positioned adjacent each of said evaporators;

(d) a plurality of generally vertically spaced shelves being positioned within each of said compartments; and (e) a product container being positioned on each of said shelves and having a bottom surface spaced above each of said shelves.

2. A refrigerated display case in accordance with claim 1 further comprising a first drain member positioned below each of said evaporators and a second drain member positioned below each of said shelves, each of said second drain members including a downwardly directed channel comprising means for conducting fluid into one of said first drains.

3. The case as recited in claim 1 further comprising a temperature equalizing valve associated with each of said shelves, each of said compartments being separated into a plurality of smaller, vertically spaced compartments by said shelves.

4. The case as recited in claim 1 wherein each of said smaller compartments includes an information display board.

5. The case as recited in claim 1 wherein said first panels are made of a thermally insulating material.

6. The case as recited in claim 1 wherein said frame has a prismatic shape.

7. The case as recited in claim 6 wherein said compartments are disposed on the lateral surfaces formed by said prismatically-shaped frame.

8. The case as recited in claim 1 wherein an end of each first panel abuts an interior portion of an adjacent first panel.

9. The case as recited in claim 1 wherein each of said second panels is substantially parallel to one of said first panels.

10. The case as recited in claim 1 wherein said plurality of first panels comprise four first panels disposed substantially perpendicularly relative to adjacent first panels, and said plurality of second panels comprise four said second panels, each said second panel being disposed substantially perpendicularly relative to a said first panel.

11. The case as recited in claim 1 further comprising a refrigerating unit, and a base, said base having a truncated-pyramid shape, the small end of said base being adapted to rest on a surface for supporting said case, said 12. The case as recited in claim 1 wherein each of said shelves is inclined.

13. The case as recited in claim 1 wherein each of said containers is spaced from a respective one of said shelves by at least two elongated spacing members positioned between the bottom of each of said container and a respective one of said inclined shelves.

14. The case as recited in claim 1 wherein the lower edge of each deflecting plate is disposed above the upper edge of a respective one of said containers.

15. The case as recited in claim 14 further comprising a housing in which said display case is supported, said housing comprising a plurality of uprights adapted to be positioned along the vertical edges of said case, said uprights being connected by cross-pieces adapted to be disposed substantially at the level of said at least one inclined shelf.

16. The case as recited in claim 2 wherein each of said first drain members includes a first orifice connected to a first evacuation channel which has an opening located above a first drain member which is associated with a lower one of said vertically arranged refrigeration compartments.

17. The case as recited in claim 1 further comprising a plurality of second drain members, each of said second drain members being positioned below a front edge of one of said inclined shelves.

18. The case as recited in claim 17 wherein each second drain member includes a second orifice connected to a second channel having an opening located above one of said first drain members which is associated with a lower one of said smaller compartments.

19. The case as recited in claim 18 further comprising a plurality of third channels for distributing refrigerating fluid from said refrigerating unit toward said vertical rows of compartments, each said third channel including means for varying fluid flow therethrough.

20. The case as recited in claim 19 wherein said means for varying fluid flow comprises means for adjusting the cross-section of a said third channel.

21. The case as recited in claim 19 further comprising a fourth channel for carrying refrigerating fluid from said refrigerating unit to said plurality of third channels.

* * * * *